US010443175B2

(12) United States Patent
Jung et al.

(10) Patent No.: US 10,443,175 B2
(45) Date of Patent: Oct. 15, 2019

(54) WASHING MACHINE HAVING MOISTURE ABSORPTION ELEMENT

(71) Applicant: LG Chem, Ltd., Seoul (KR)

(72) Inventors: Sang Yun Jung, Daejeon (KR); Cheol-Hee Park, Daejeon (KR); Kwon Il Choi, Daejeon (KR); Shin Hee Jun, Daejeon (KR); Dae Ki Lee, Daejeon (KR); Myoung hwan Oh, Daejeon (KR)

(73) Assignee: LG Chem, Ltd. (KR)

( * ) Notice: Subject to any disclaimer, the term of this patent is extended or adjusted under 35 U.S.C. 154(b) by 1 day.

(21) Appl. No.: 15/567,488

(22) PCT Filed: Jul. 27, 2016

(86) PCT No.: PCT/KR2016/008241

§ 371 (c)(1),
(2) Date: Oct. 18, 2017

(87) PCT Pub. No.: WO2017/023012

PCT Pub. Date: Feb. 9, 2017

(65) Prior Publication Data

US 2018/0135217 A1 May 17, 2018

(30) Foreign Application Priority Data

Jul. 31, 2015 (KR) ..... 10-2015-0109124
Jul. 26, 2016 (KR) ..... 10-2016-0094947

(51) Int. Cl.
*D06F 25/00* (2006.01)
*D06F 58/26* (2006.01)
(Continued)

(52) U.S. Cl.
CPC ..... *D06F 25/00* (2013.01); *D06F 37/04* (2013.01); *D06F 58/24* (2013.01); *D06F 58/26* (2013.01);
(Continued)

(58) Field of Classification Search
CPC ..... D06F 25/00
See application file for complete search history.

(56) References Cited

U.S. PATENT DOCUMENTS 4,094,652 A 6/1978 Lowther
2002/0000537 A1 1/2002 Daikaku et al.
(Continued)

FOREIGN PATENT DOCUMENTS

CN 1931795 A 3/2007
CN 101348597 A 1/2009
(Continued)

OTHER PUBLICATIONS

International Search Report for Application No. PCT/KR2016/008241, dated Nov. 1, 2016.
(Continued)

*Primary Examiner* — Jason Y Ko
(74) *Attorney, Agent, or Firm* — Lerner, David, Littenberg, Krumholz & Mentlik, LLP

(57) ABSTRACT

The present invention relates to a washing machine which can reduce energy required for a washing cycle and a drying cycle. The washing machine includes a moisture absorption element containing porous aluminosilicate, in which the porous aluminosilicate has a Si/Al atomic ratio of 15 or less and a total specific volume ($V_{total}$) of pores of 0.3 $cm^3/g$, the $V_{total}$ of pores being defined as sum of $V_{meso}$ and $V_{micro}$.

6 Claims, 2 Drawing Sheets

(51) Int. Cl.

| | |
|---|---|
| ***D06F 37/04*** | (2006.01) |
| ***D06F 58/24*** | (2006.01) |
| *D06F 58/20* | (2006.01) |
| *D06F 39/00* | (2006.01) |
| *D06F 39/04* | (2006.01) |

(52) U.S. Cl.
CPC ..... *D06F 39/006* (2013.01); *D06F 39/04* (2013.01); *D06F 58/20* (2013.01)

(56) References Cited

U.S. PATENT DOCUMENTS

| | | | | |
|---|---|---|---|---|
| 2005/0016010 | A1* | 1/2005 | Pyo | G06F 58/24 34/62 |
| 2008/0295696 | A1 | 12/2008 | Kim | |
| 2009/0036590 | A1* | 2/2009 | Oobayashi | C08K 3/34 524/450 |
| 2011/0166010 | A1* | 7/2011 | Hagemeyer | B01J 21/06 502/74 |
| 2013/0071610 | A1 | 3/2013 | Deville et al. | |
| 2013/0152420 | A1 | 6/2013 | Tissler et al. | |
| 2014/0342156 | A1 | 11/2014 | Seo et al. | |

FOREIGN PATENT DOCUMENTS

| | | | |
|---|---|---|---|
| CN | 101962192 | A | 2/2011 |
| CN | 101687175 | B | 11/2012 |
| CN | 103038171 | A | 4/2013 |
| DE | 3626887 | A1 | 2/1988 |
| EP | 3184873 | A1 | 6/2017 |
| JP | H08259220 | A | 10/1996 |
| JP | 2003320216 | A | 11/2003 |
| JP | 20110010769 | A | 1/2011 |
| JP | 2011194352 | A | 10/2011 |
| JP | 2013111521 | A | 6/2013 |
| KR | 101998078423 | | 11/1998 |
| KR | 100203853 | B1 | 6/1999 |
| KR | 20050012100 | A | 1/2005 |
| KR | 100640787 | B1 | 10/2006 |
| KR | 100724298 | B1 | 6/2007 |
| KR | 20080104643 | A | 12/2008 |
| KR | 20090036253 | A | 4/2009 |
| KR | 20130023234 | A | 3/2013 |
| KR | 1020140014192 | A | 2/2014 |
| KR | 20140069200 | A | 6/2014 |
| KR | 1020170006951 | A | 1/2017 |
| KR | 1020170048850 | A | 5/2017 |
| KR | 1020170048851 | A | 5/2017 |
| WO | 2012174374 | A2 | 12/2012 |

OTHER PUBLICATIONS

Liu, et al., Synthesis, characterization, and mercury adsorption properties of hybrid mesoporous aluminosilicate sieve prepared with fly ash, Applied Surface Science, May 15, 2013, pp. 706-716, vol. 273.

Stephen Brunauer, et. al., Adsorption of Gases in Multimolecular Layers, Journal, Feb. 1938, pp. 309-319, vol. 60 (2), Journal of the American Chemical Society.

* cited by examiner

WASHING MACHINE HAVING MOISTURE ABSORPTION ELEMENT

CROSS-REFERENCE TO RELATED APPLICATIONS

The present application is a national phase entry under 35 U.S.C. § 371 of International Application No. PCT/KR2016/008241, filed Jul. 27, 2016, which claims priority from Korean Patent Application No. 10-2015-0109124, filed Jul. 31, 2015, and Korean Patent Application No. 10-2016-0094947, filed Jul. 26, 2016 with the Korean Intellectual Property Office, the disclosures of which are herein incorporated by reference in their entireties.

TECHNICAL FIELD

The present invention relates to a washing machine, and more specifically, to a drum-type washing machine-cum-dryer having a moisture absorption element.

CROSS-REFERENCE TO RELATED APPLICATIONS

This application claims the benefit of priority based on Korean Patent Application No. 10-2015-0109124, filed Jul. 31, 2015, and Korean Patent Application No. 10-2016-0094947, filed Jul. 26, 2016 with the Korean Intellectual Property Office, the disclosures of which are herein incorporated by reference in their entireties.

BACKGROUND OF ART

A drum-type washing machine is a machine that washes laundry using detergent and water in a drum by rotating the drum using a driving force from a motor. This drum-type washing machine has advantages that it causes less damage to the laundry, the laundry is not frequently tangled, and the amount of water use is small.

Recently, a drum-type washing machine-cum-dryer has been widely used, which allows the laundry to be dried by blowing hot air into a drum through a drying duct. This drum-type washing machine-cum-dryer washes laundry while optionally or sequentially performing a washing cycle, a rinsing cycle, a dehydrating cycle, a drying cycle, and the like.

FIG. 1 illustrates a side cross-sectional view schematically showing a main structure of a conventional drum-type washing machine-cum-dryer.

Referring to FIG. 1, a drum-type washing machine is generally configured to include a cabinet 10 having a laundry loading opening formed on the front side thereof, a door 11 installed at the laundry loading opening of the cabinet 10 to be opened and closed, a tub 20 installed inside the cabinet 10 to hold washing water, a drum 22 rotatably installed in the tub 20, and a motor 50 installed on the tub 20 to transmit a driving force to the drum 22.

The drum-type washing machine is also provided with a drying duct 60 and a condensing duct 70 which are adapted to circulate air for a drying cycle. A heater 63 and a blowing fan 67 are installed in the drying duct 60 so that hot air can be charged into the tub 20. The drying duct 60 and the condensing duct 70 are installed so as to communicate with each other, and to communicate with the inside of the drum 22. The tub 20 has an intake port formed thereon through which hot air is drawn via the drying duct 60, and an exhaust port through which air is discharged into the condensing duct 70. The condensing duct 70 is provided with a water supply nozzle 75 adapted to supply cooling water so as to allow moisture in the air to condense.

In the drum-type washing machine configured as described above, a washing cycle and a drying cycle are generally performed in the following manner.

The door 11 is opened by a user and the laundry is loaded into the drum 22. Then, the door 11 is closed to make the drum 22 airtight. When a washing cycle is started, a water supply device 15 supplies water. The supplied water is heated by a heater 17 and mixed with detergent in a detergent container 12, and then supplied into the tub 20, where the water flows into the drum 22 via through-holes to wet the laundry. Subsequently, the motor 50 is driven to rotate the drum 22 for a preset washing time, and then the dirty water in the tub 20 is drained outside the washing machine through a drain hose 83 by the action of a drain pump 80.

When a drying cycle is started, power is applied to the heater 63 and the blowing fan 67 in the drying duct 60 to generate hot air. The generated hot air flows into the drum 22 by guidance of the drying duct 60. The hot air in the drum 22 is converted into low temperature and high humidity air while heating the laundry to dryness, and the low temperature and high humidity air is discharged into the condensing duct 70 through the exhaust port of the tub 20. The low temperature and high humidity air supplied to the condensing duct 70 is condensed by the cooling water supplied via the water supply nozzle 75 to precipitate moisture. The thus-dried air again flows into the drying duct 60 by the blowing fan 67. A series of these processes is repeatedly performed to dry the laundry.

However, these washing and drying cycles involve the use of energy for heating water and air, and energy loss due to loss of condensation heat, etc., which inevitably results in use of a large amount of thermal energy and loss related thereto.

Since the drum-type washing machine has a relatively long washing time and high power consumption, multiple attempts have been made to reduce energy use and loss in the washing and drying cycles by increasing the energy efficiency of a heating device or a condensing device. However, limitations have been encountered with regard to saving energy through the efficiency increase of such devices.

In particular, recently, as the size of washing machines has become larger and emphasis has been made on the importance of environment-friendly products, there is a growing need to save energy.

DETAILED DESCRIPTION OF THE INVENTION

Technical Problem

It is an object of the present invention to provide a washing machine which can reduce energy required for a washing cycle and a drying cycle.

Technical Solution

According to one embodiment of the present invention, a washing machine having a moisture absorption element containing porous aluminosilicate is provided, in which an atomic ratio of Si/Al is 15 or less and a total specific volume $V_{total}$ of pores, which is defined as a volumetric sum of $V_{meso}$ and $V_{micro}$, is 0.3 $cm^3/g$ or more, wherein:

the $V_{meso}$ represents a Barrett-Joyner-Halenda (BJH) cumulative volume of mesopores having a pore size of 2 to 300 nm; and the $V_{micro}$ represents a volume of micropores having a pore size of less than 2 nm, as calculated from argon adsorption Brunauer-Emmett-Teller (BET) surface area by the t-plot method.

According to one embodiment of the present invention, the washing machine includes:

a cabinet 10 having a laundry loading opening formed thereon;

a door 11 installed at the laundry loading opening to be opened and closed;

a tub 20 installed inside the cabinet 10 to hold washing water;

a drum 22 rotatably installed in the tub;

a motor 50 installed on the tub to transmit a driving force to the drum; and a drying duct 60 fixed to an outer peripheral surface of an upper side of the tub in which its both ends are connected to an intake port and an exhaust port of the tub such that the drying duct circulates hot air inside the drum, wherein the drying duct 60 includes a moisture absorption element 65 containing the porous aluminosilicate, a heater 63 attached to an outer peripheral surface of the moisture absorption element and adapted to heat the moisture absorption element and air, and a blowing fan 67 adapted to circulate air.

Hereinafter, a washing machine according to embodiments of the invention will be described.

Firstly, throughout the specification, it is to be understood that the terminology used herein is for the purpose of describing specific embodiments only and is not intended to limit the invention unless explicitly stated otherwise.

As used herein, the singular forms "a", "an", and "the" also include plural forms unless the context clearly dictates to the contrary.

Also, it is to be understood that the terms "comprise" and "include," and variations such as "comprises," "comprising," "includes", and "including," as used herein, specify the presence of stated features, regions, integers, steps, operations, elements, or components, but do not preclude the presence or addition of other specific features, regions, integers, steps, operations, elements, or components.

According to one embodiment of the invention, a washing machine having a moisture absorption element containing porous aluminosilicate is provided, in which the atomic ratio of Si/Al is 15 or less and the total specific volume $V_{total}$ of pores, which is defined as the volumetric sum of $V_{meso}$ and $V_{micro}$, is 0.3 $cm^3/g$ or more, wherein:

the $V_{meso}$ represents a Barrett-Joyner-Halenda (BJH) cumulative volume of mesopores having a pore size of 2 to 300 nm; and the $V_{micro}$ represents a volume of micropores having a pore size of less than 2 nm, as calculated from argon adsorption Brunauer-Emmett-Teller (BET) surface area by the t-plot method.

Preferably, the porous aluminosilicate has a $V_{meso}$ of 0.05 $cm^3/g$ or more, or 0.05 to 1.0 $cm^3/g$, which may be advantageous for the expression of various characteristics according to the invention. Specifically, the $V_{meso}$ may be 0.05 $cm^3/g$ or more, 0.09 $cm^3/g$ or more, 0.1 $cm^3/g$ or more, 0.15 $cm^3/g$ or more, 0.2 $cm^3/g$ or more, 0.25 $cm^3/g$ or more, or 0.5 $cm^3/g$ or more; and may be 1.0 $cm^3/g$ or less, 0.6 $cm^3/g$ or less, or 0.55 $cm^3/g$ or less.

Also, the porous aluminosilicate has a $V_{micro}$ of 0.01 $cm^3/g$ or more, or 0.01 to 0.5 $cm^3/g$, which may be advantageous for the expression of all characteristics according to the invention. Specifically, the $V_{meso}$ may be 0.01 $cm^3/g$ or more, 0.03 $cm^3/g$ or more, 0.06 $cm^3/g$ or more, 0.09 $cm^3/g$ or more, 0.1 $cm^3/g$ or more, 0.15 $cm^3/g$ or more, 0.2 $cm^3/g$ or more, or 0.25 $cm^3/g$ or more; and may be 0.5 $cm^3/g$ or less, 0.3 $cm^3/g$ or less, or 0.28 $cm^3/g$ or less.

In addition, the porous aluminosilicate has a total specific volume ($V_{total}$) of pores, defined as sum of $V_{meso}$ and $V_{micro}$, of 0.03 $cm^3/g$ or more, or 0.3 to 0.8 $cm^3/g$, which may be advantageous for the expression of various characteristics according to the invention. Specifically, the $V_{total}$ may be 0.3 $cm^3/g$ or more, 0.32 $cm^3/g$ or more, or 0.34 $cm^3/g$ or more; and may be 0.8 $cm^3/g$ or less, 0.7 $cm^3/g$ or less, or 0.65 $cm^3/g$ or less.

Further, preferably, the porous aluminosilicate has an argon adsorption Brunauer-Emmett-Teller (BET) surface area of 200 $m^2/g$ or more, or 200 to 850 $m^2/g$. Specifically, the BET surface area may be 200 $m^2/g$ or more, 250 $m^2/g$ or more, 300 $m^2/g$ or more, 350 $m^2/g$ or more, or 370 $m^2/g$ or more; and may be 850 $m^2/g$ or less, 800 $m^2/g$ or less, 750 $m^2/g$ or less, or 730 $m^2/g$ or less.

As a result of experiments by the present inventors, it has been found that, when a moisture absorption element containing a porous aluminosilicate which satisfies the volumetric properties of pores and the atomic ratio of Si/Al, etc. as aforementioned is applied to a washing machine, it is possible to reduce energy required for the washing and drying cycles. This is due to the following principles.

First, the porous aluminosilicate, which exhibits the aforementioned various characteristics, such as the volumetric properties of pores and the specific surface area, may exhibit excellent moisture absorption characteristics and also a high moisture absorption amount under conditions of room temperature and high humidity corresponding to the conditions in the drying duct. Therefore, a drying cycle for the laundry may be appropriately performed by using a moisture absorption element containing the porous aluminosilicate.

Moreover, since the moisture-absorbing process of the porous aluminosilicate corresponds to an exothermic reaction, adsorption heat generated during this process may be used for heating the air for drying. Therefore, the energy used or lost in the drying cycle may be greatly reduced, or the drying cycle may be allowed to proceed substantially without additional energy input.

For example, the porous aluminosilicate contained in a moisture absorption element of one embodiment may exhibit, at 25° C. and relative humidity of 95%, an excellent moisture absorption amount which is sufficient to reach 22% or more, or 22% to 50%, wherein the moisture absorption amount (% at 25° C., 95% RH) is defined by the following Formula 1. This high moisture absorption amount enables generation of high adsorption heat. Therefore, the moisture absorption element of one such embodiment may preferably be used for the drying cycle of the washing machine to exhibit an energy saving effect.

$$\text{Moisture Absorption Amount (\% at 25° C., 95\% RH)} = [W\,(g)/AS\,(g)]*100 \quad \text{[Formula 1]}$$

In Formula 1, AS (g) represents the weight of the porous aluminosilicate, and W (g) represents the weight of water is been maximally absorbed by AS (g) of the porous aluminosilicate when moisture is absorbed using the porous aluminosilicate.

On the other hand, after the drying cycle has been performed using the moisture absorption element, it is necessary to undergo a process of desorbing the moisture absorbed from the moisture absorption material. It has been confirmed that in the case of the moisture absorption element of one embodiment, particularly the porous aluminosilicate satisfying the range of the Si/Al atomic ratio, the volumetric properties of pores, etc. as aforementioned, a considerable amount of moisture can be naturally desorbed by simply lowering the relative humidity. In particular, as the $V_{meso}$ range of 0.05 $cm^3/g$ or more, or 0.05 to 1.0 $cm^3/g$ is satisfied, the proportion of naturally desorbing moisture may be further increased.

For example, the porous aluminosilicate contained in the moisture absorption element of one embodiment has a ratio of moisture absorption amount per relative humidity of 1.2 or more, 1.22 to 5.0, or 1.24 to 3.0, wherein the ratio of moisture absorption amount is defined by the following Formula 2. Therefore, a very high level (for example, about 30% or more) of natural moisture desorption may be achieved simply by lowering the relative humidity from 95% to 50% without additional energy input.

Ratio of moisture absorption amounts per relative humidity=moisture absorption amount (% at 25° C.,95% RH)/moisture absorption amount (% at 25° C.,50% RH) [Formula 2]

In Formula 2, the moisture absorption amount (% at 25° C., 95% RH) represents the moisture absorption amount as defined by the aforementioned Formula 1, the moisture absorption amount (% at 25° C., 50% RH) represents the moisture absorption amount calculated according to the formula [W1 (g)/AS (g)]*100, when the moisture is desorbed from the porous aluminosilicate in a state of the relative humidity being lowered from 95% to 50%, wherein W1 (g) represents the weight of water that has been maximally absorbed by AS (g) of the porous aluminosilicate after the moisture has been desorbed.

Thereby, once the drying cycle proceeds, the moisture absorption element of one embodiment can also reduce the amount of energy required for desorbing moisture therefrom. On the contrary, when the porous aluminosilicate that does not satisfy the characteristics of one embodiment is applied, it has been confirmed that relatively natural moisture desorption is not sufficiently performed, thereby increasing the amount of energy use.

In addition, a certain level of condensation heat may be generated in the process of desorbing moisture from the moisture absorption element of the above embodiment, and such condensation heat may also be applied as energy for heating water in the washing cycle. Therefore, also in this respect, the moisture absorption element of one embodiment can reduce the energy use or loss of the washing machine, thereby achieving a great energy saving effect.

On the other hand, as for the porous aluminosilicates exhibiting the aforementioned characteristics, those exhibiting the above physical properties among previously commercially available porous aluminosilicates can be selected and used, or they may be directly prepared and used. For example, as for these porous aluminosilicates, a porous aluminosilicate in the form of a zeolite in which cations of alkali metals, alkaline earth metals, or transition metals such as Ca cations, Na cations, K cations, or Fe cations are bound to anions of aluminosilicate, may be used.

Specifically, the porous aluminosilicate may be represented by the following Chemical Formula 1.

$$M_xSiAl_yO_a(OH)_b(H_2O)_c \quad \text{[Chemical Formula 1]}$$

In Chemical Formula 1, M represents an alkali metal, an alkaline earth metal, or a transition metal, x and y each independently represent a positive number, and a, b, and c represent a number of 0 or more (provided that a+b is a positive number).

In this Chemical formula 1, M may be Ca, Na, K, or Fe, and x, y, a, b, and c may be determined in consideration of the valence of each constituent element or ion.

Preferably, the porous aluminosilicate has a Si/Al atomic ratio of 15 or less, or more than 1 and not more than 15, which may be advantageous for the expression of the various aforementioned characteristics. Specifically, the Si/Al atomic ratio may be 15 or less, 13.5 or less, 13 or less, or 12.5 or less; and may be more than 1.0, 1.1 or more, or 1.2 or more.

In a specific example, examples of the commercially available porous aluminosilicates may include BEA-type or 13X-type zeolite, and the like.

Also, examples of the suitable methods capable of preparing the porous aluminosilicate exhibiting the aforementioned characteristics may include a method for preparing the porous aluminosilicate by coupled alkali-mediated dissolution and precipitation reactions of porous aluminosilicate precursors in an aqueous medium.

In this case, as for the silicon sources, fumed silica, silicate, aluminosilicate, clay, minerals, metakaolin, activated clay, fly ash, slag, pozzolans, etc. may be used. As for aluminum sources, alumina, aluminate, aluminum salt, clay, metakaolin, activated clay, fly ash, slag, pozzolans, etc. may be used.

By way of a non-limiting example, according to an embodiment of the invention, the porous aluminosilicate may be prepared by a method including the steps of: i) adding a silicon source, an aluminum source, and water to a basic or alkaline solution (for example, a sodium hydroxide solution) and stirring the mixture, thereby forming a geopolymer resin which satisfies a specific metal atomic ratio (for example, Na:Al:Si=3:1:2); ii) heat-treating the geopolymer resin at a low temperature (e.g., 60° C. to 80° C.) under atmospheric pressure; and iii) washing and neutralizing the heat-treated geopolymer resin.

In particular, according to an embodiment of the invention, the porous aluminosilicate exhibiting the aforementioned various characteristics may be obtained by heat-treating a geopolymer resin satisfying a specific metal atomic ratio under the conditions of atmospheric pressure and a low temperature (e.g., 60° C. to 80° C., preferably 65° C. to 75° C.).

On the other hand, the porous aluminosilicate exhibiting the aforementioned various characteristics may be used per se as a moisture absorption element of one embodiment, or may have an appropriate additive, etc. added thereto to prepare a moisture absorption element for use in one embodiment. In this case, the type of additive that may be used is not particularly limited, and any additive previously known to be contained in a moisture absorption element may be used.

On the other hand, referring to FIG. 2, the washing machine according to an embodiment of the invention includes:

a cabinet 10 having a laundry loading opening formed thereon;

a door 11 installed at the laundry loading opening to be opened and closed;

a tub 20 installed inside the cabinet to hold washing water;

a drum 22 rotatably installed in the tub;

a motor 50 installed on the tub to transmit a driving force to the drum; and a drying duct 60 fixed to an outer peripheral surface of an upper side of the tub and having its respective ends connected to an intake port and an exhaust port of the tub such that the drying duct circulates hot air inside the drum.

In particular, the drying duct 60 includes a moisture absorption element 65 therein containing the porous aluminosilicate, a heater 63 attached to an outer peripheral surface of the moisture absorption element and adapted to heat the moisture absorption element and air, and a blowing fan 67 adapted to circulate air.

The washing machine according to an embodiment of the invention shown in FIG. 2 further includes a moisture absorption element 65 provided in the drying duct 60 and does not include a condensing duct 70 and a water supply nozzle 75, as compared with the conventional washing machine shown in FIG. 1.

In the conventional washing machine of FIG. 1, the condensing duct 70, through which the cooling water supplied via the water supply nozzle 75 flows, is a means for lowering the humidity by condensing the low temperature and high humidity air discharged from the drum 22 during the drying cycle.

However, as the washing machine according to an embodiment of the invention is provided with the moisture absorption element 65 which contains the porous aluminosilicate satisfying the aforementioned various characteristics, it may exhibit excellent moisture absorption characteristics under a high humidity condition, thereby allowing the drying cycle to be performed even without any means corresponding to the condensing duct.

In particular, since the moisture-absorbing process of the porous aluminosilicate contained in the moisture absorption element 65 corresponds to an exothermic reaction, the adsorption heat generated during this process may be used for heating air in order to perform a drying cycle. Therefore, the energy used or lost in the drying cycle may be greatly reduced, or the drying cycle can be performed substantially without additional energy input.

Further, in the case of the porous aluminosilicate satisfying the aforementioned various characteristics, a considerable amount of moisture can be naturally desorbed simply by lowering the relative humidity. Accordingly, if the relative humidity becomes lower after the completion of the drying cycle, the moisture can be naturally desorbed from the moisture absorption element 65. If necessary, the heater 63 and the blowing fan 67 may be operated during the washing cycle so that the moisture is desorbed from the moisture absorption element 65.

In addition, condensation heat may be generated in the process of desorbing moisture from the porous aluminosilicate contained in the moisture absorption element 65, and such condensation heat may also be used as energy for heating water in the washing cycle.

The moisture absorption element 65 contains the aforementioned porous aluminosilicate, and may be, for example, one in which the porous aluminosilicate is filled in a container.

Further, the moisture absorption element 65 may be mounted at the inside or on one side wall of the drying duct 60. For example, the moisture absorption element 65 may be provided inside the drying duct 60 while being coupled to the heater 63, wherein a flow path of high humidity air being circulated by the blowing fan 67 may be provided at a position where the high humidity air may go through or contact the moisture absorption element 65.

The washing machine according to an embodiment of the present invention washes laundry while optionally or sequentially performing a washing cycle, a rinsing cycle, a dewatering cycle, and a drying cycle according to the following manner with reference to FIG. 2.

First, the door 11 is opened by a user and the laundry is loaded into the drum 22. Then, the door 11 is closed to make the drum 22 airtight. When a washing cycle is started, a water supply device 15 supplies water. The supplied water is heated by a heater 17 and mixed with detergent in a detergent container 12, and then supplied into the tub 20, where it flows into the drum 22 via through-holes to wet the laundry. Subsequently, the motor 50 is driven to rotate the drum 22 for a preset washing time, and then the dirty water in the tub 20 is drained outside the washing machine through a drain hose 83 by the action of a drain pump 80. During this washing cycle, power may be applied, if necessary, to the heater 63 and the blowing fan 67 in the drying duct 60 so that the moisture is desorbed from the moisture absorption element 65. The condensation heat generated in the process of desorbing moisture from the moisture absorption element 65 may flow into the drum 22 and used as energy for heating water.

When a rinsing cycle is started, clean water is supplied into the tub 20 through the water supply device 15, and the motor 50 is driven for a preset rinsing time. If the preset rinsing time has elapsed, the motor 50 is stopped, the drain pump 80 pumps, and the water having bubbles in the tub 20 is drained outside the washing machine through the drain hose 83.

When a dehydrating cycle is started, the motor 50 is driven to rotate the drum 22 at a high speed for a preset dehydrating time. The laundry in the drum 22 is dehydrated by the centrifugal force. At this time, the drain pump 80 pumps, and the water that has come out of the laundry is drained outside the washing machine through the drain hose 83.

When a drying cycle is started, power is applied to the heater 63 and the blowing fan 67 in the drying duct 60 to generate hot air. The generated hot air flows into the drum 22 by guidance of the drying duct 60. The hot air in the drum 22 is converted into low temperature and high humidity air while heating the laundry to dryness, and the low temperature and high humidity air is discharged into the drying duct 60 through the exhaust port of the tub 20. Here, the term "low temperature" means a temperature (e.g., room temperature) that is lower than that of the air heated by the heater. The low temperature and high humidity air supplied to the drying duct 60 is circulated toward the moisture absorption element 65 by the blowing fan 67 and is allowed to lose moisture and dry by the moisture-absorbing action of the moisture absorption element 65. A series of these processes is repeatedly performed to dry the laundry.

As described above, upon driving of the washing machine, the simultaneous operation of both the heater 17 for heating water and the heater 63 for desorbing moisture from the moisture absorption element 65 in the washing cycle allows additional use of the condensation heat generated in the process of desorbing moisture from the moisture absorption element 65. In particular, as the adsorption heat (e.g., 0.17 kWh per unit weight (kg) of the porous aluminosilicate) is generated by the moisture-absorbing action of the moisture absorption element 65 in the drying cycle, it is possible to perform the drying cycle without additional condensing means (for example, a condensing duct).

Advantageous Effects

A washing machine according to the present invention makes it possible to reduce energy required for a washing cycle and a drying cycle.

DETAILED DESCRIPTION OF THE EMBODIMENTS

Figure 1:
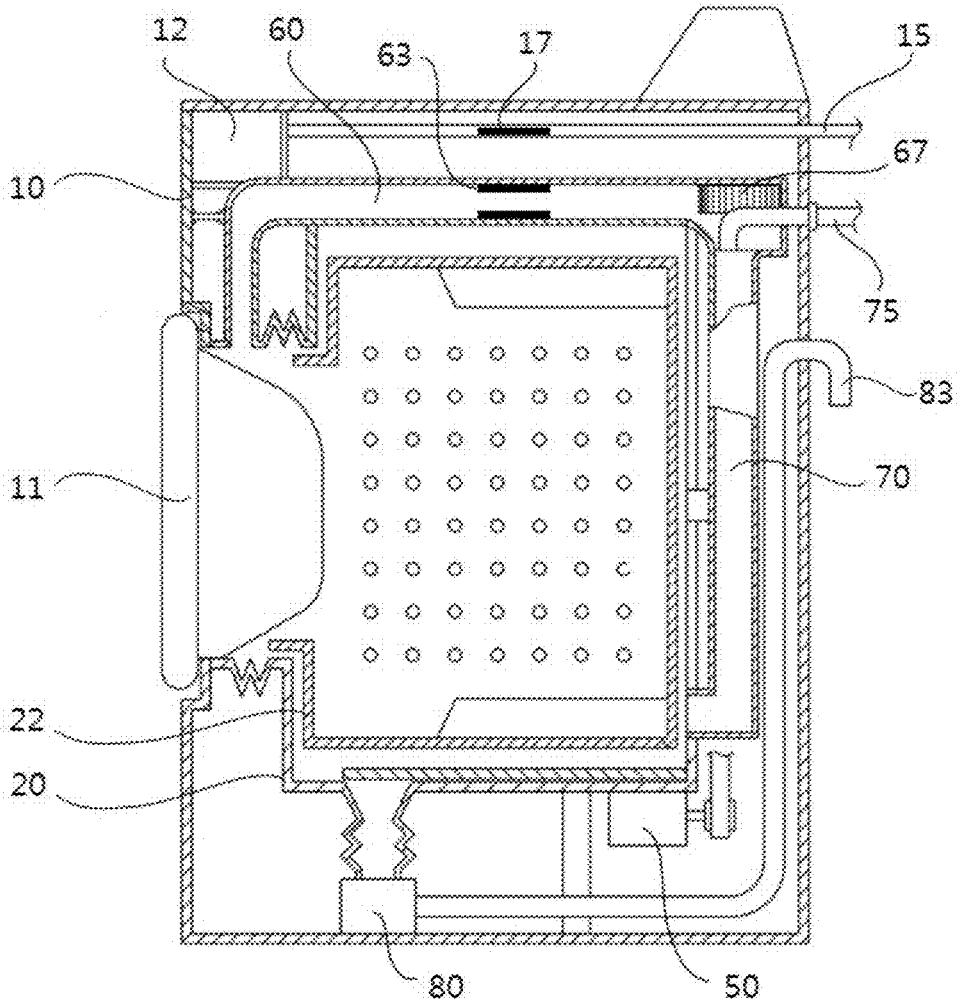
FIG. 1 illustrates a side cross-sectional view schematically showing an internal structure of a conventional laundry machine.

For a better understanding of the present invention, preferred examples are given below. However, the following examples are given merely to illustrate the present invention and are not intended to limit the scope of the invention thereto.

Example 1

3.02 g of NaOH and then 5.43 g of tertiary distilled water were added to a reactor, and allowed to mix well. To this solution, 7.76 g of sodium silicate (~10.6% $Na_2O$, ~26.5% $SiO_2$) was added, and the mixture was completely dissolved by stirring at 800 rpm at room temperature. To the thus-prepared solution, 3.8 g of metakaolin was added and stirred at 800 rpm for 40 minutes at room temperature, thereby obtaining a geopolymer resin having a Na:Al:Si atomic ratio of about 3:1:2.

The geopolymer resin was heated in an oven under the conditions of atmospheric pressure and 70° C. for one day, thereby obtaining a geopolymer resin having a pH level of 14. The heat-treated geopolymer resin was washed with a sufficient amount of tertiary distilled water and centrifuged at 10,000 rpm for 5 minutes, and then a clear supernatant having a pH level of 14 was decanted. These washing, centrifugation, and decantation steps were repeated until the supernatant had a pH level of 7. The neutralized geopolymer resin was allowed to dry overnight in a vacuum oven at 80° C., thereby obtaining porous aluminosilicate as a final product.

Example 2

A BEA-type zeolite (trade name: CP814E) available from Zeolyst International was prepared as Example 2.

Example 3

A 13X-type zeolite (trade name: COLITE-MS80) available from Cosmo Fine Chemicals was prepared as Example 3.

Comparative Example 1

A ZSM-5-type zeolite (trade name: CBV8014) available from Zeolyst International was prepared as Comparative Example 1.

Experimental Example 1

Various physical properties of the aluminosilicates of the above examples and comparative example were measured and the results are shown in Table 1 below.

The Si/Al atomic ratio was analyzed using ICP-OES Optima 7300DV. Specifically, each sample was aliquoted into a Corning tube (50 ml) for analysis of Si/Al atomic ratio, and then an anti-static gun was used to remove static electricity. Hydrochloric acid and hydrofluoric acid were added o the sample, and allowed to dissolve. Then, this solution was diluted with ultrapure water. After taking 1 ml of the solution, a supersaturated boric acid solution and scandium (Sc), that is, an internal standard, were added thereto, and diluted again with ultrapure water. Standard solutions were prepared as Blank, 1 μg/ml, 5 μg/ml, and 10 μg/ml. The Si/Al atomic ratio of the solution diluted with ultrapure water was analyzed by the ICP-OES Optima 7300DV.

TABLE 1

| | Example 1 | Example 2 | Example 3 | Comparative Example 1 |
|---|---|---|---|---|
| Si/Al atomic ratio | 1.5 | 12.5 | 1.2 | 40 |
| $V_{total}$ ($cm^3/g$) | 0.54 | 0.64 | 0.34 | 0.26 |
| $V_{meso}$ ($cm^3/g$) | 0.26 | 0.55 | 0.09 | 0.09 |
| $V_{micro}$ ($cm^3/g$) | 0.28 | 0.09 | 0.25 | 0.17 |
| BET ($m^2/g$) | 730 | 370 | 677 | 435 |
| Moisture absorption amount according to Formula 1 (% at 25° C., 95% RH) | 24.65 | 43.02 | 27.71 | 10.54 |
| Moisture absorption amount (% at 25° C., 50% RH) | 16.02 | 15.93 | 22.26 | 8.54 |
| Moisture absorption amount (% at 25° C., 0% RH) | 6.43 | 1.92 | 15.03 | 1.14 |
| Ratio of moisture absorption amount for each relative humidity according to Formula 2 | 1.54 | 2.70 | 1.24 | 1.23 |
| Natural moisture desorption in consideration of Formula 2 (%) | 35 | 63 | 20 | 19 |

BET ($m^2/g$): the Brunauer-Emmett-Teller (BET) surface area $V_{meso}$ ($cm^3/g$): the Barrett-Joyner-Halenda (BJH) cumulative volume of mesopores having a pore size of 2 nm to 300 nm $V_{micro}$ ($cm^3/g$): volume of micropores having a pore size of less than 2 nm, as calculated from argon adsorption Brunauer-Emmett-Teller (BET) surface area by the t-plot method $V_{total}$ ($cm^3/g$): total pore volume Experimental Example 2

(Energy Consumption Calculated when Applied to a Washing Machine)

Figure 2:
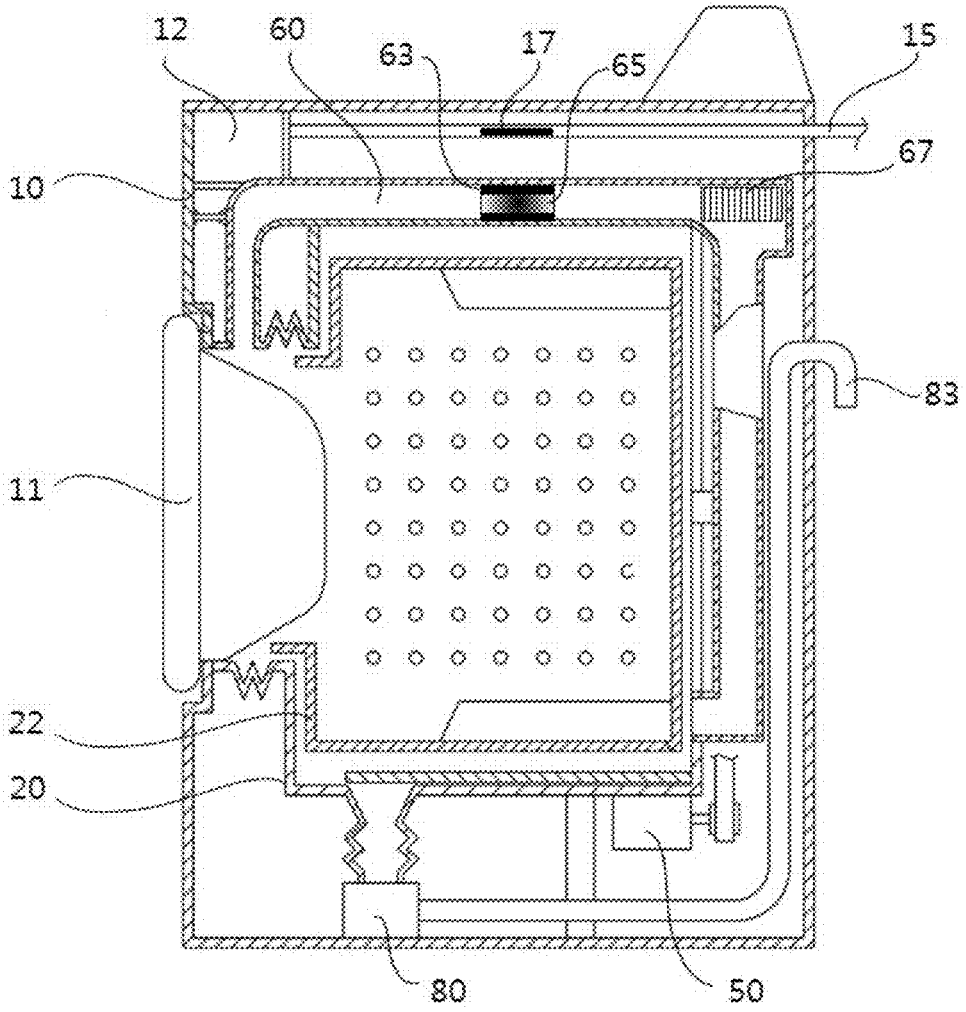
FIG. 2 illustrates a side cross-sectional view schematically showing an internal structure of a washing machine according to one embodiment of the present invention.

2 kg of each aluminosilicate according to the above examples and comparative example was applied to the washing machine of FIG. 2 as a moisture absorption element 65, and washing and drying cycles were allowed to proceed.

The amount of water (washing water) used in the washing cycle was 7 L, and its temperature was elevated from an initial temperature of 15° C. to 40° C. in order for the washing cycle to proceed. The amount of laundry was 3 kg. During the drying cycle, 0.5 kg of water was dried and removed, and the temperature was elevated from 30° C. to 60° C. The amount of energy required for these washing and drying cycles was calculated.

Further, the amount of energy required for the washing and drying cycles performed under the same conditions except that the aluminosilicate was not applied (Comparative Example 2, that is, the same cycles as the conventional washing and drying cycles but without use of a moisture absorption element) was calculated, and the data is summarized in Table 2 below.

TABLE 2

| | | Example 1 (kWh) | Example 2 (kWh) | Example 3 (kWh) | Comparative Example 1 (kWh) | Comparative Example 2 (kWh) |
|---|---|---|---|---|---|---|
| Washing cycle | Energy for desorbing moisture from moisture absorption material[A] | 0.22 | 0.13 | 0.27 | 0.28 | 0 |
| | Energy required for heating (temperature elevation of) washing water[B] | 0.20 | 0.20 | 0.20 | 0.20 | 0.20 |
| | Energy saved by utilization of condensation heat from moisture absorption material[C] | −0.08 | −0.09 | −0.07 | −0.03 | 0 |
| Drying cycle | Energy required for heating (temperature elevation and drying of) air[D] | 0.34 | 0.34 | 0.34 | 0.34 | 0.35 |
| | Energy saved by utilization of adsorption heat from moisture absorption material | −0.34 | −0.34 | −0.34 | −0.34 | 0 |
| Basic energy required for operation and maintenance of laundry machine | | 0.03 | 0.03 | 0.03 | 0.03 | 0.03 |
| Total energy consumption | | 0.37 | 0.27 | 0.43 | 0.48 | 0.58 |

A. Energy for desorbing moisture from moisture absorption material {[Energy required based on the assumption that there is no natural moisture desorption (0.34 kWh/2 kg of moisture absorption material)]−[Energy saved due to natural moisture desorption]};

*"Energy saved due to natural moisture desorption":

(1) Example 1: 0.34 kWh per moisture absorbing material*35%=0.12 kWh (2) Example 2: 0.34 kWh per moisture absorbing material*63%=0.21 kWh (3) Example 3: 0.34 kWh per moisture absorbing material*20%=0.07 kWh (4) Comparative Example 1: 0.34 kWh per moisture absorption material*19%=0.06 kWh B. Energy required for heating (temperature elevation of) washing water=energy for elevating temperature of 7 kg of water from 15° C. to 40° C.;

C. Energy saved by utilization of condensation heat from moisture absorption material=[(moisture absorption amount (% at 25° C., 95% RH))−(moisture absorption amount (% at 25° C., 0% RH))]*vaporization heat (40° C.)*(1-natural moisture desorption)

D. Energy required for heating (temperature elevation and drying of) air:

(1) Examples 1, 2, and 3 and Comparative Example 1=vaporization heat (30° C.)

(2) Comparative Example 2=energy required for elevating temperature of air (30° C.→60° C.)+vaporization heat (60° C.)

Referring to Table 2, it is confirmed that the energy saving effect of Examples 1 to 3 was significantly larger than that of Comparative Examples 1 and 2.

EXPLANATION OF NUMBERS

10: Cabinet
11: Door
12: Detergent container
15: Water supply device
17: Water heater
20: Tub
22: Drum
50: Motor
60: Drying duct

63: Air heater
65: Moisture absorption element
67: Blowing fan
70: Condensing duct
75: Water supply nozzle
80: Drain pump
83: Drain hose

The invention claimed is:

1. A washing machine comprising:

a drum; and a drying duct for circulating hot air inside the drum;

wherein the drying duct includes a moisture absorption element containing porous aluminosilicate therein, a heater attached to an outer peripheral surface of the moisture absorption element and adapted to heat the moisture absorption element and air, and a blowing fan adapted to circulate air, wherein the moisture absorption element containing the porous aluminosilicate has an atomic ratio of Si/Al of 15 or less and a total specific volume $V_{total}$ of pores, which is defined as a volumetric sum of $V_{meso}$ and $V_{micro}$, of 0.3 $cm^3/g$ or more, wherein:

the $V_{meso}$ represents a Barrett-Joyner-Halenda (BJH) cumulative volume of mesopores having a pore size of 2 to 300 nm; and the $V_{micro}$ represents a volume of micropores having a pore size of less than 2 nm, as calculated from argon adsorption Brunauer-Emmett-Teller (BET) surface area by the t-plot method.

2. The washing machine according to claim 1, further comprising:

a cabinet having a laundry loading opening formed thereon;

a door installed at the laundry loading opening to be opened and closed;

a tub installed inside the cabinet to hold washing water; and a motor installed on the tub to transmit a driving force to the drum;

wherein the drum is rotatably installed in the tub; and the drying duct is fixed to an outer peripheral surface of an upper side of the tub in which its respective ends are connected to an intake port and an exhaust port of the tub such that the drying duct circulates hot air inside the drum.

3. The washing machine according to claim 1, wherein the porous aluminosilicate has the $V_{meso}$ of 0.05 $cm^3/g$ or more.

4. The washing machine according to claim 1, wherein the porous aluminosilicate has, at 25° C. and relative humidity of 95%, a moisture absorption amount of 22% or more, the moisture absorption amount (% at 25° C., 95% RH) being defined by the following Formula 1, and has a ratio of moisture absorption amounts per relative humidity of 1.2 or more, the ratio of moisture absorption amounts being defined by the following Formula 2:

Moisture absorption amount (% at 25° C.,95% RH)=[*W* (g)/AS (g)]*100 [Formula 1]

Ratio of moisture absorption amounts per relative humidity=moisture absorption amount (% at 25° C.,95% RH)/moisture absorption amount (% at 25° C.,50% RH) [Formula 2]

wherein, in Formula 1, AS (g) represents the weight of the porous aluminosilicate and W (g) represents the weight of water that has been maximally absorbed by AS (g) of the porous aluminosilicate when the moisture has been absorbed using the porous aluminosilicate, and in Formula 2, the moisture absorption amount (% at 25° C., 95% RH) represents the moisture absorption amount as defined by the above Formula 1, the moisture absorption amount (% at 25° C., 50% RH) represents the moisture absorption amount calculated according to the formula of [W1 (g)/AS (g)]*100 when the moisture is desorbed from the porous aluminosilicate in a state of the relative humidity being lowered from 95% to 50%, wherein W1 (g) represents the weight of water that has been maximally absorbed by AS (g) of the porous aluminosilicate after the moisture has been desorbed.

5. The washing machine according to claim 1, wherein the porous aluminosilicate has an argon adsorption Brunauer-Emmett-Teller (BET) surface area of 200 $m^2/g$ or more.

6. The washing machine according to claim 5, wherein the porous aluminosilicate is represented by Chemical Formula 1 as shown below:

$M_xSiAl_yO_a(OH)_b(H_2O)_c$ [Chemical Formula 1]

wherein, in Chemical Formula 1, M represents an alkali metal, an alkaline earth metal, or a transition metal, x and y each independently represent a positive number, and a, b, and c represent a number of 0 or more, provided that a+b is a positive number.

* * * * *